United States Patent [19]

Carrier

[11] 4,337,461

[45] Jun. 29, 1982

[54] VOLUME CONTROL MECHANISM FOR A BELL ASSEMBLY

[75] Inventor: John A. Carrier, Chilwell, England

[73] Assignee: Plessey Handel und Investments A.G., Zug, Switzerland

[21] Appl. No.: 166,327

[22] Filed: Jul. 7, 1980

[30] Foreign Application Priority Data

Jul. 10, 1979 [GB] United Kingdom ..... 7924064

[51] Int. Cl.[3] ..... G10K 1/063

[52] U.S. Cl. ..... 340/402; 116/149; 340/392; 340/401; 340/403

[58] Field of Search ..... 340/402, 392, 401, 403; 116/149, 152

[56] References Cited

U.S. PATENT DOCUMENTS

| | | | |
|---|---|---|---|
| 2,643,634 | 6/1953 | Hoyka | 340/402 |
| 3,671,958 | 6/1972 | Storz | 116/149 |

FOREIGN PATENT DOCUMENTS

| | | | |
|---|---|---|---|
| 1462254 | 9/1969 | Fed. Rep. of Germany | 340/402 |
| 1164151 | 9/1969 | United Kingdom . | |

*Primary Examiner*—Harold I. Pitts

*Attorney, Agent, or Firm*—Fleit & Jacobson

[57] ABSTRACT

An indexing mechanism for the volume control of a telephone bell comprises a slot and associated indexing notches which co-operate with a guide pin and an indexing pin respectively. Volume control is effected by forcing the indexing pin over one or more notches as desired. The volume setting is not easily altered by vibration of the instrument.

3 Claims, 4 Drawing Figures

VOLUME CONTROL MECHANISM FOR A BELL ASSEMBLY

The present invention relates to a volume control mechanism for a bell assembly and more particularly but not exclusively to control lever arrangements for bell volume controls for telephone subscribers instruments.

The present invention concerns a control lever arrangement including an indexing mechanism which provides a plurality of positions for the lever selectable in predetermined steps.

Figure 1:
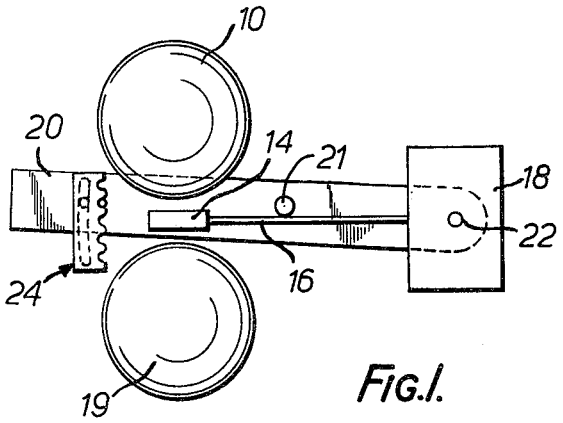
Figure 2C:
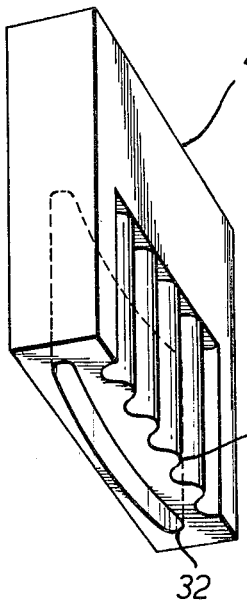
Figure 2B:
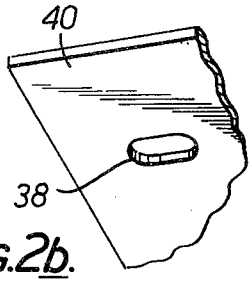
Figure 2A:
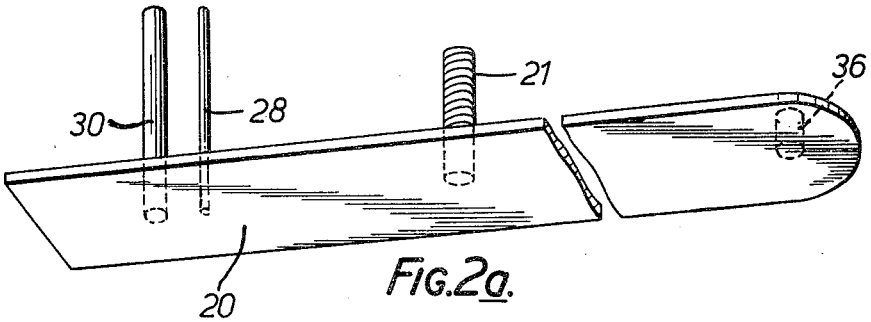

Embodiments of the present invention will now be described by way of example with reference to the accompanying drawings in which:

FIG. 1 shows in diagramatic plan view of part of a telephone instrument having a control lever arrangement according to the present invention and FIGS. *2a, 2b* and *2c* show the control lever indexing system of FIG. 1 in greater detail.

Referring now to FIG. 1, a telephone bell comprises two bell domes 10, 12 which are struck by a ringer hammer 14 attached via a ringer stem 16 to a motor/vibrator 18. Volume control is provided by an upright coil or leaf spring 21 which is constrained to press with variable force against the stem 16 by a volume control lever 20 which is pivoted at pivot 22 as shown. Pivot 22 is preferably an integral part of the mounting for the ringer motor 18 since this is economical. The indexing mechanism is shown at 24 and will be described in greater detail with reference to FIGS. *2a, 2b* and *2c*. The indexing mechanism comprises a first shaped portion 26 attached to the telephone body and at least a second shaped portion such as the pin 28 attached to the lever 20.

Referring now to FIG. *2a*, the pin 28 has a relatively small diameter and is attached rigidly to the lever 20 and at a fixed distance from a guide pin 30 which is relatively strong and of larger diameter. The pins 28, 30 co-operate in operation with the block 26 shown in FIG. *2c*. The guide pin 30 moves inside a guide pin slot or track 32, and the indexing pin 28 moves in a stepped manner along indexing notches 34, the pin 28 being flexible enough to be deflected as it moves from notch to notch. The notches 34 can be made of equal pitch or the pitch can be varied. The advantage of a variable pitch is that each step can be made to approximately give the same alteration in volume control even though the spring and lever arrangement produces a non-linear relationship. The track 32 and notches 34 are made slightly arcuate to take into account the movement of the pins 30, 32 in an arc.

For good operation the pins 28, 30 must be accurately aligned with the track 32 and notches 34. Because of the closeness of the pins 28, 30 and the track and notches 32, 34, it is possible to mould these components accurately with respect to each other. However, aligning the block 26 with the pins 28, 30 can present a problem. This is overcome in a preferred embodiment illustrated in FIGS. *2b* and *2c* by providing the lever arm 20 with an upstanding pin 36 which pivots within a slot 38 on the lever mounting bracket 40. The lever is held in position by, for example, the base of the telephone.

Although the arrangement has been described with reference to a bell volume control mechanism for a telephone it is applicable to any type of control where reasonably accurate control is required over a long period of time. The indexing mechanism is not easily shifted during movement of the telephone, which movement can occur with present volume control mechanisms.

The choice of the material for the pins 28, 30 and the block 26 can provide a stiff or relatively easy movement for the control lever. The parts are preferably plastic mouldings, but the pins 30 and 28 could be made of steel, the pin 28 (for example) being made of spring steel.

What we claim is:

1. A volume control mechanism for a bell assembly having at least one bell dome and a bell ringer hammer supported on the end of a pivoted stem, comprising a resilient member, said resilient member being movable into contact with said stem to apply different predetermined forces to said stem so as to vary the amplitude of movement of said stem and said ringer hammer when in operation, a lever, said lever being pivoted adjacent to said stem pivot in the same plane as said stem and supporting said resilient member, a resilient rod and a rigid rod, said resilient rod and said rigid rod being secured to said lever with their axes perpendicular to the plane of movement of said lever, a block, said block being fixed relative to the at least one bell dome and having guide means for guiding said rigid rod and a plurality of grooves formed thereon, the axes of said grooves being perpendicular to the plane of movement of said lever, said resilient rod engaging said grooves being perpendicular to the plane of movement of said lever, said resilient rod engaging said grooves formed in said block and said rigid rod engaging said guide means formed in said block, whereby said rigid rod in said guide means maintains said resilient rod in contact with said grooves at all times.

2. A volume control mechanism as claimed in claim 1 wherein said guide means in the block comprises an elongated slot into which the rigid rod projects.

3. A volume control mechanism as claimed in claim 2 wherein an elongate slot is provided at the pivot of said lever whereby said lever is provided with a degree of axial movement to permit said lever to be readily located with said rigid rod projecting into said elongate slot in said block.

* * * * *